United States Patent [19]

Dashner et al.

[11] 4,092,812

[45] June 6, 1978

[54] SILICONE GLAZING SYSTEM

[75] Inventors: Richard F. Dashner, Wheaton, Ill.; George J. Bouchey, Millburn, N.J.

[73] Assignee: General Electric Company, Waterford, N.Y.

[21] Appl. No.: 712,123

[22] Filed: Aug. 5, 1976

[51] Int. Cl.[2] ..... E04C 1/00

[52] U.S. Cl. ..... 52/309.3; 52/397; 52/400; 52/403; 52/127; 52/746

[58] Field of Search ..... 52/397, 400, 403, 402, 52/398, 616, 309, 127, 741, 746, 202, 203

[56] References Cited

U.S. PATENT DOCUMENTS

| | | | |
|---|---|---|---|
| 2,554,058 | 5/1951 | Phipps | 52/397 |
| 2,979,788 | 4/1961 | Richardson | 52/400 X |
| 3,652,380 | 3/1972 | Strack | 52/397 X |
| 3,720,025 | 3/1973 | Eichman | 52/397 X |
| 3,846,948 | 11/1974 | Dallen | 52/400 |
| 3,881,290 | 5/1975 | Bouchey | 52/397 X |
| 3,978,626 | 9/1976 | Weinar | 52/127 |

*Primary Examiner*—Ernest R. Purser
*Assistant Examiner*—Carl D. Friedman
*Attorney, Agent, or Firm*—E. Philip Koltos; John L. Young; Frank L. Neuhauser

[57] ABSTRACT

A silicone glazing system for supporting and retaining a glass pane wherein the window frame is lined with a spacer rod composed of a heat cured vulcanizable silicone rubber composition of a Durometer A Hardness of at least 30, and the window pane is placed and rested against the spacer rod. There is applied a room temperature vulcanizable silicone rubber sealant over the exposed areas of the spacer rods so as to join and bind the window pane to the window frame.

16 Claims, 10 Drawing Figures

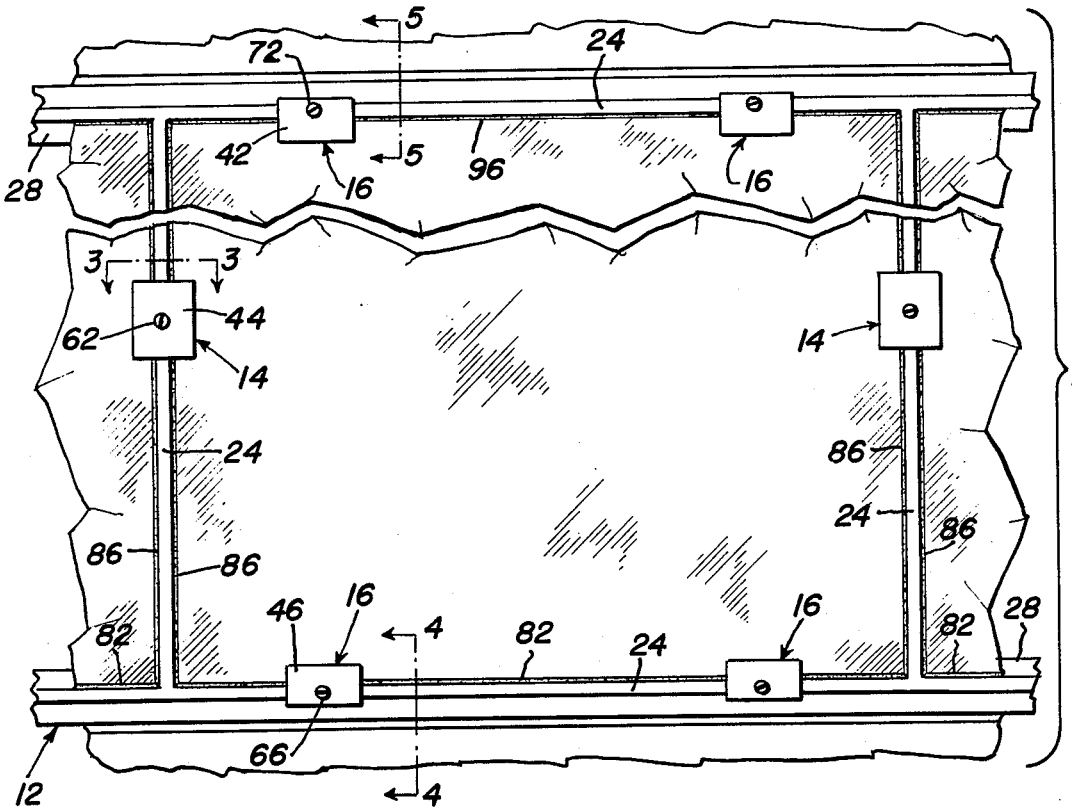
Fig. 1.
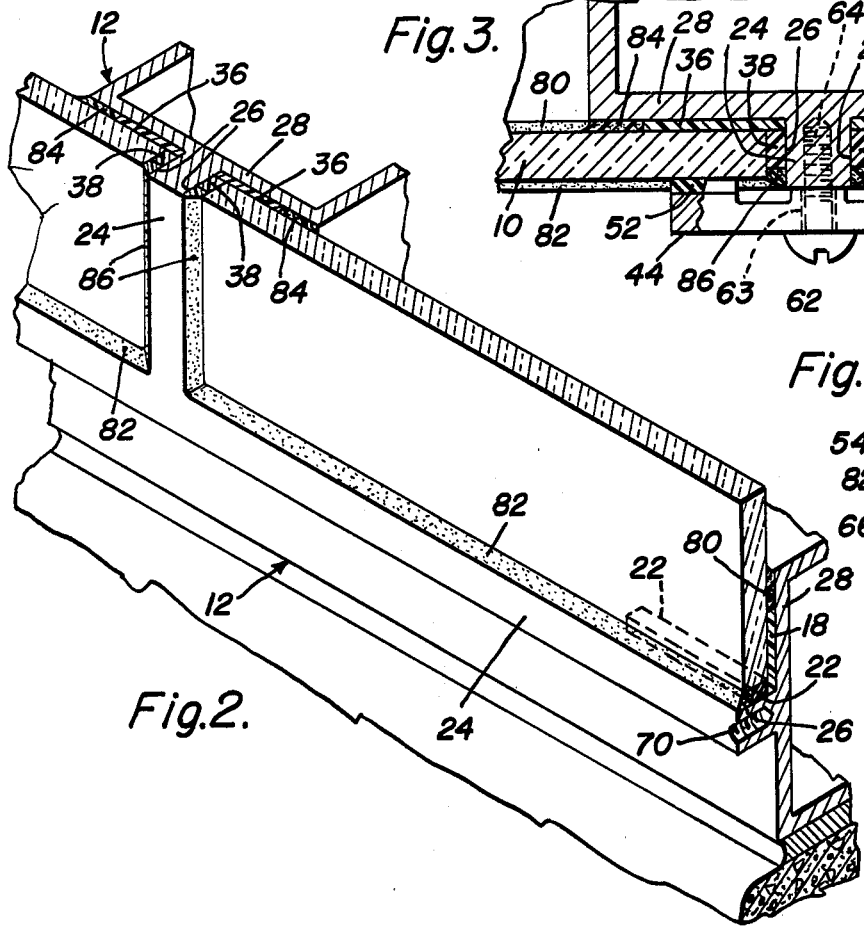
Fig. 2.
Fig. 3.
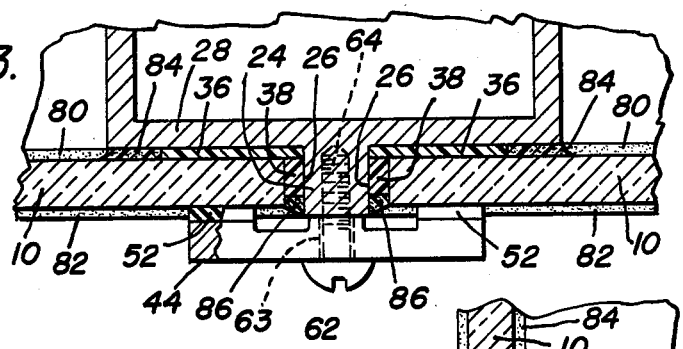
Fig. 4.
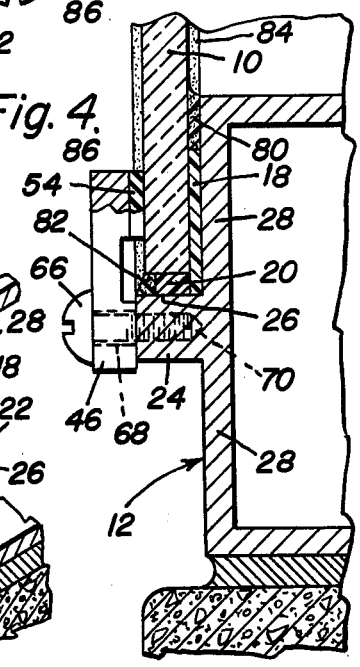

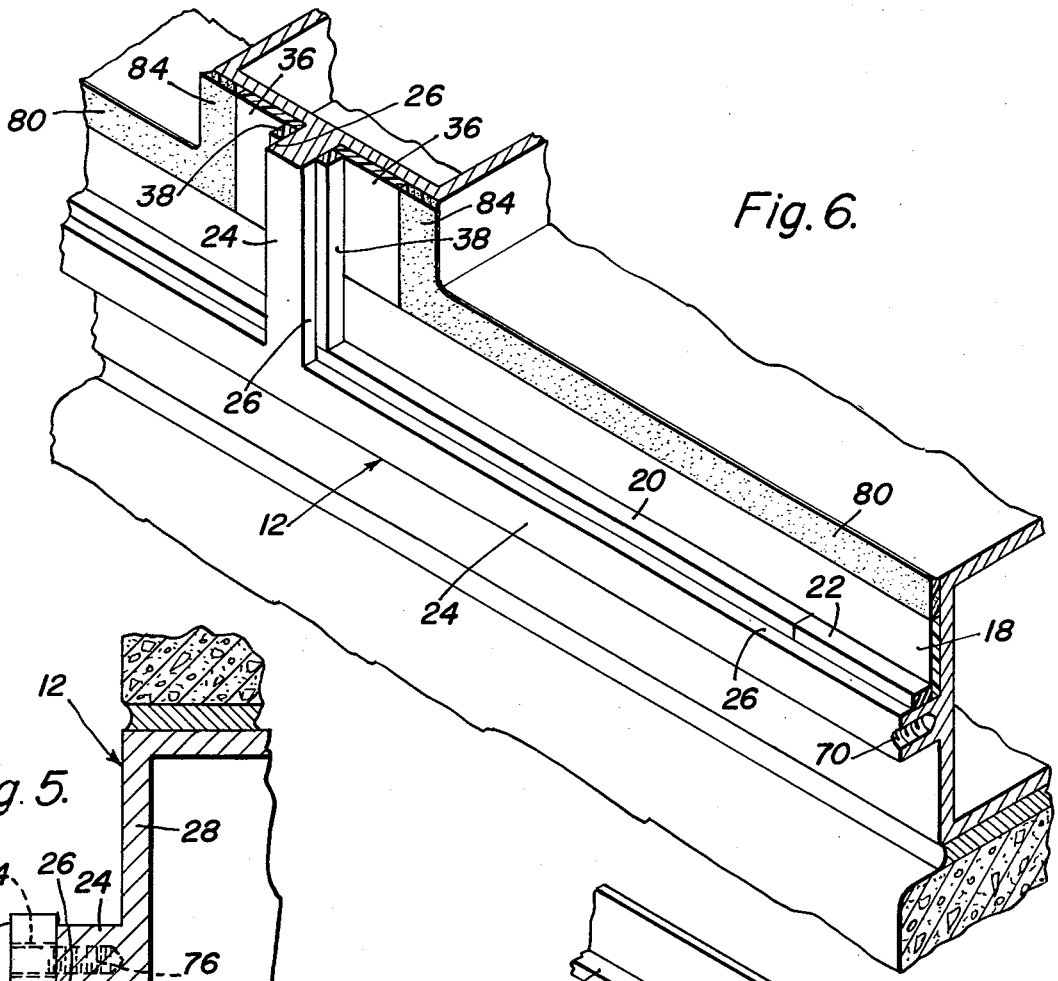
Fig. 6.
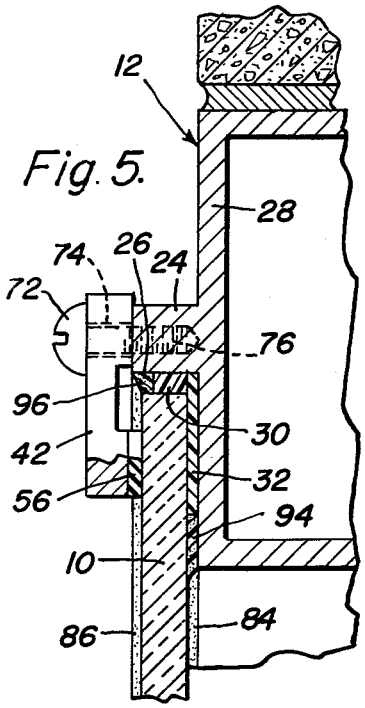
Fig. 5.
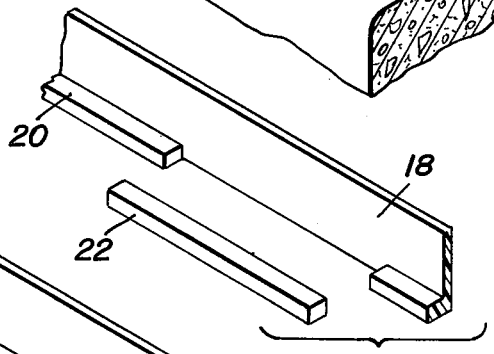
Fig. 7.
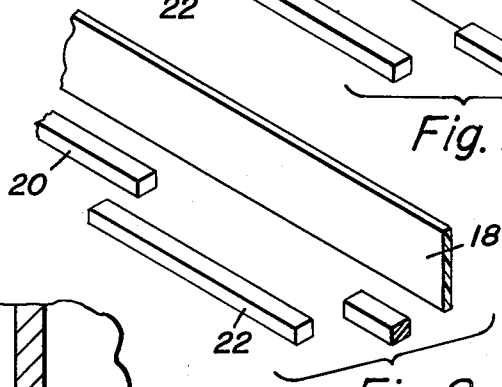
Fig. 8.
Fig. 9.
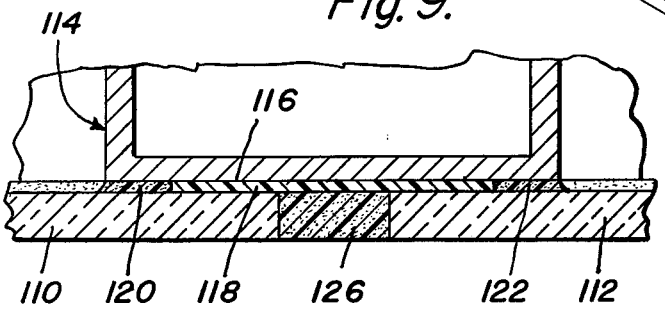
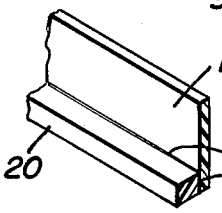
Fig. 10.

SILICONE GLAZING SYSTEM

BACKGROUND OF THE INVENTION

The present invention relates to glazing systems and more particularly relates to glazing systems composed of a silicone spacer rod constructed from heat vulcanizable silicone rubber compositions which in the cured state has a Durometer A Hardness of at least 30 and a room temperature vulcanizable silicone sealant.

It has been a relatively recent architectural design of high rise buildings to have large window panes for most if not all of the exterior wall of the building. In general the tendency has been to increase the size of the window pane so as to cover as large an area of the exterior wall of the building as is possible. This design results both in an improved aesthetic effect in the appearance of the building, as well as providing a large amount of natural lighting to the interior of the building.

In the past, it was common to support such large glass window panes in such buildings by inserting them in metal support brackets, such that there was an exterior edge or bracket on the window frame which supported and held in place the window pane.

Recently, it has become highly desirable in terms of economy in the construction of such buildings, as well as improving the aesthetic appearance of the building, to have the window panes inserted flush with the exterior wall of the building such that there are no unsightly metal brackets or protrusions from the walls of the building. The means that has been provided for accomplishing this construction is to provide a window frame with a lip side extending perpendicular to the wall of the building and extending from the interior of the building flush to the exterior wall of the building. To this lip side there is appended perpendicular to it at the interior side of the building a resting side of the window frame on which the glass window pane can be rested. The glass pane is then held in place by applying a sealant around the interior faces of the glass pane or the edges of the pane or both, bonding the glass pane to the metal window frame. Thus, when the sealant is cured such a sealant completely supports and retains the window pane in place on the side of the building. This allows for a construction where the window pane is flush and in plane with the exterior wall of the building.

However, one major difficulty was encountered with such a construction in that the use of a silicone sealant as a sole supporting element of the window pane to the window frame of the building resulted in an undue load being placed on the sealant in some cases. Thus, in such a construction, the sealant had to withstand the total stresses of the window pane expanding and contracting, as well as the result of pressure differentials between the interior and the exterior of the building which might result in movement of the window pane.

Accordingly, to overcome this problem it was in some cases suggested that a spacer rod be inserted in the window frame around the edges of the window frame such that the window pane would rest upon and against the spacer rod. Then the sealant would be applied to join the edges of the glass pane with the window frame. The use of such spacer rods was for the purpose of acting as a cushioning device and as a stress sharer with the sealant in maintaining and supporting the glass pane in the window frame. Such spacer rods in the past have been fabricated of butyl rubber, vinylchloride, and Neoprene.

While Neoprene rubber has a desirable characteristic as a resting material because of its excellent hardness such that it can have a Durometer A of 75–90 or more, it does not have sufficient cushioning properties as a spacer rod along all the edges of the window pane.

Further in the case of the butyl rubber spacer rods, it was found such butyl rubber spacer rods in many cases did not have a sufficiently high Durometer A Hardness unless reinforcing material was incorporated in such rods and in general were very difficult to apply because of their unvulcanized state as they were used by the construction workers in the field.

In addition, in the case of Neoprene when utilized as a spacer rod it was found that such Neoprene had to be heated at very cold temperatures in order for it to be worked on properly and placed into the proper location in the window frame.

In addition, both butyl rubber tape and Neoprene would bleed out various uncured ingredients in their compositions which would gradually contaminate and degrade any sealant that came into contact with it.

In addition, if it was desired to join or make any other adhesions with such prior art spacer rods and other materials such joining and adhesion of other materials to such spacer rods was particularly difficult in some cases requiring vulcanization at the point of installation.

Accordingly, it was highly desirable to provide for an all-silicone spacer rod silicone sealant system for the installation of window panes that would be flush with the exterior side of buildings.

Accordingly, it is one object of the present invention to provide for a silicone glazing system composed of a spacer rod which is constructed from cured heat vulcanizable silicone rubber compositions having a Durometer A Hardness in the cured state of at least 30 and a room temperature vulcanizable silicone sealant.

It is another object of the present invention to provide a silicone spacer rod and a silicone sealant that are compatible with each other where the spacer rod will not degrade or effect the silicone sealant.

It is an additional object of the present invention to provide a spacer rod and a silicone sealant that are easy to apply in normal as well as abnormal construction temperatures and which, especially in the case of the spacer rod, can be handled with ease and facility in its installation in the window frame.

It is yet an additional object of the present invention to provide a process for the installation of window panes flush with the exterior wall of the building where said window panes are supported by silicone spacer rods and a silicone sealant.

THE DRAWINGS

FIG. 1 is a front fragmented view of a window pane which is flush with the exterior wall of the building indicating the window frame in which the window pane is located and the metal brackets that are used to hold the window pane in place while it is being installed.

FIG. 2 is a perspective view of the lower part of the window pane of FIG. 1, showing the silicone spacer rods and the silicone sealant in place supporting the window pane.

FIG. 3 is a cross-sectional view along lines 3—3 of FIG. 1.

FIG. 4 is a cross-sectional view along lines 4—4 of FIG. 1.

FIG. 5 is a cross-sectional view along lines 5—5 of FIG. 1.

FIG. 6 is a perspective view of the lower part of the window frame of FIG. 2 with the silicone spacer rod and silicone sealant in place, but without the window pane.

FIG. 7 is a perspective view of a spacer rod, with a cutout for the resting block and a Neoprene resting block being pictured therein.

FIG. 8 is the same as FIG. 7, except while the spacer rod of FIG. 7 is constructed all in one section, the spacer rod of FIG. 8 is constructed in more than one section.

FIG. 9 is the cross-sectional top view showing a slightly different modification of supporting the window pane than is shown in FIGS. 1 through 6, in which a silicone sealant and a spacer rod is utilized to join and support adjacent window panes.

FIG. 10 is a side view of FIG. 8 where a supporting layer of silicone sealant is utilized to adhere the separate sections of the silicone spacer rods to each other.

SUMMARY OF THE INVENTION

There is provided by the present invention a silicone glazing system for supporting and retaining a glass pane with a size of at least 16 square feet wherein there is present a building frame having retaining sides therein for supporting said glass pane, comprising a spacer rod extending along at least one side of said building frame which spacer rod is formed from cured heat vulcanizable silicone rubber of at least 30 Durometer A Hardness and a layer of room temperature vulcanizable silicone sealant on at least one side of said spacer rod and at least one side of said spacer rod a layer of room temperature vulcanizable silicone sealant applied over said spacer rod and joining and adhering said glass pane to said building frame. The sealant must extend along all sides of the window pane. Preferably, the spacer rod also extends on all sides of the window pane. Generally, the spacer rod need only be one-eighth of an inch thick and one-eighth of an inch wide to provide the proper support. Of course, as can be envisioned, these sizes may be larger depending upon the construction limitations on the particular window frame, that is, the amount of sealant that has to be applied over the spacer rod and the depth of sealant that has to be applied to properly join and support and hold in place the window pane to the window frame. In that respect, it is preferred generally that the layer of silicone sealant that is applied over the spacer rod joining the window pane to the window frame be at least one-eighth of an inch thick and one-eighth of an inch wide. Although a spacer rod may be utilized which extends only behind the window pane in said window frame, it is preferred that the spacer rod be of such construction that it extends behind the window pane in said window frame and also extends so as to cover and support at least the thickness of the edges of said window pane.

Preferably, in such spacer rod construction at the bottom spacer rod inserts there are sections cut out for Neoprene resting blocks. It has been found that the Neoprene resting blocks are more suited for supporting the weight of the glass pane because of their high Durometer being in the neighborhood of 75 – 90. In such a case the silicone spacer rod acts as a cushioning device at the point below the window pane while the Neoprene supports most of the weight of the window pane.

The spacer rods extending along any one side of the window pane may be constructed from one separate piece of silicone material or may be constructed in various sections.

The window pane is generally installed by applying the spacer rods whether in separate sections or in one integral piece around the window frame and also placing the Neoprene resting blocks in place. The window pane is then held in place by metal brackets which are supported by threaded bolts into the side of the metal window frame. At this point the proper sized layer of silicone sealant is applied over all exposed surfaces of the spacer rod joining the window pane to the window frame and allowed to cure to support the glass pane in the window frame.

DESCRIPTION OF THE PREFERRED EMBODIMENT

FIG. 1 shows the window pane 10 held in the window frame 12 by means of vertical brackets 14 and horizontal brackets 16. A more detailed view of the construction is to be found in FIGS. 2, 3, 4, 5, and 6.

FIGS. 2 and 6 show a silicone vertical spacer rod 18 and the horizontal spacer rod 20, both of which spacer rods are constructed in two different sections with the window pane 10 resting on spacer rod 20 and against spacer rod 18. In FIG. 2 there is also shown in dotted lines the portion of the bottom spacer rod 20 that is cut out and which is replaced by a Neoprene setting block 22 more clearly seen in FIG. 6. It should be stated here that the setting block may be made from any acceptable material which has a sufficient hardness to withstand, cushion and support the weight of the glass. The preferred material from which a setting block can be made is Neoprene with a Durometer A Hardness in the range of 75–90.

Previously, setting blocks were sized to support the weight of the specific pane used in each installation. Generally the length and width were chosen to allow distribution of the pane's weight. Normally the width was the full width of the sill member so that it would be impossible for the glass to slip off the setting block. Normally, the block width was equal to the glass thickness. In the present invention, there must be placed a bead of sealant in front of the block to provide a weather seal, therefore the setting block must be wide enough to fill the cutout opening in the silicone spacer rod and extend to within one-eighth to three-sixteenths inch of the outer pane face. If this is not done the block might turn or slip when the glass pane is placed on it.

As pointed out in the drawings and as will be pointed out later, the setting blocks do not have to comprise or take up the whole bottom supporting edge of window pane 10. Setting blocks 22 are cut out such that they generally may have a thickness and a width varying anywhere from one-half inch up to the thickness of the glass pane. It is preferred in that respect that they not be any larger but be of the same dimensions in width and thickness as the bottom silicone spacer rod.

The sole purpose of the setting blocks and specifically the Neoprene setting blocks is to support most of the weight of the window pane. The bottom spacer rod still performs the same function as stated previously of cushioning some of the weight of the window pane as well as allowing the proper positioning of the window pane in the window frame 12. The silicone spacer rod as will be described herein is needed to set the position in which the window pane will rest at a given distance from the window frame. The silicone spacer rods 18 and 20 are also needed to give the proper resiliency and cushioning effect to the window pane to prevent undue stresses on the silicone sealant.

As can be more clearly seen in FIGS. 2, 3, 4, 5 and 6 the window frame comprises an external ridge 24 which is formed by lip edges 26 and supporting side 28. The vertical sections of the silicone spacer rods 18 rests against side 28. The setting blocks 22 as well as the silicone spacer rod 20 rests against the lip side 26 of the window frame 12.

Accordingly, referring to FIG. 5, in the construction of the window or insertion of the window pane into the window frame, the upper spacer rods 30 and 32 are inserted into place and the side spacer rods 36 and 38 are also inserted into place as shown in FIG. 3, as well as the bottom spacer rods 18 and 20 as shown in FIG. 4.

It should be mentioned at this point that in all the drawings as indicated the spacer rods shown to be constructed in two sections, that is, the spacer rods 20, 30, and 38 which rest on protruding lip 26 of the window frame, can be all in one section or composed of the smaller sections as well as in the case of spacer rods 18, 36, and 32 resting against the retaining edge 28 of window frame 12. As shown in FIG. 2, the Neoprene resting blocks are also inserted into place. It should be mentioned that the length of such setting blocks 22 is determined solely by the size that is necessary to support most of the weight of window pane 10. Generally, the size can vary anywhere from 3 to 12 inches in length or more. Most preferably, setting blocks of a size of 3 to 8 inches is most preferred, where at least 2 of such resting blocks 22 are needed such resting blocks being inserted into cut out portions of bottom spacer rod 20 at a distance of about one-quarter inch from the sides of the glass pane as indicated in FIGS. 2 and 6. It is preferred that there be two such resting blocks at the bottom side of the window pane. Thus, in accordance with the invention, the setting blocks merely support most of the weight of the window pane but the bottom silicone spacer rods are the ones that provide the positioning effect of the insertion of the window pane 10 into the window frame 12 as well as provide the cushioning effect in any movement of the window pane 10. After being put in place against the spacer rods, as mentioned above, the window pane 10 is held in place by brackets 14 and 16 and more specifically in FIGS. 2, 3 and 4 by metal brackets 42, 44 and 46. Such metal brackets may have one or two arms as is necessary. Such metal brackets have at that portion of the bracket that comes in contact with the window pane 10 rubber cushion layers 52, 54 and 56 in brackets 44, 46 and 42, respectively. These rubber cushion layers are merely present on brackets 44, 46 and 42 for the purpose such that the bracket will not scratch the window pane 10 when the bracket is forced against window pane 10 so as to support window pane 10 in window frame 12. The brackets are positioned so as to support window pane 10 in the case of bracket 44 by screw 62 which passes through opening 63 and threads into threaded opening 64; by screw 66 passing through opening 68 and threading into threaded opening 70 for bracket 46, and by screw 72 passing through opening 74 in bracket 42 and being threaded into threaded opening 76 for bracket 42.

Accordingly, as can be more clearly seen in conjunction with FIGS. 2, 3, 4 and 5 these metal brackets 44, 46 and 42 are screwed into place by screws 52, 66 and 72, support window pane 10 and window frame 12 against the appropriate spacer rods discussed previously.

At this time, the silicone sealant is applied over the exposed layers of the spacer rods, for instance as can be seen in FIG. 2, a layer of silicone sealant 80 is applied over spacer rod 18 bonding window pane 10 to retaining side 28 a layer of silicone sealant 82 is applied at the bottom edge bonding window pane 10 to protruding lip side 26.

A more clear view of these layers of silicone sealant is to be found in FIGS. 3, 4, 5 and 6. In FIG. 3 silicone sealant 84 is applied to bond window pane 10 to supporting sides 28 of window frame 12 and a layer of a silicone sealant 86 is applied to bond window pane 10 to protruding lip side 26.

In FIG. 4 a layer of silicone sealant 80 is applied to bond window pane 10 to retaining side 28 and a layer of silicone sealant 82 is applied to bond protruding lip side 26 to window pane 10.

As also can be seen in FIG. 5, a layer of silicone sealant 94 is applied to bond retaining side 28 to window pane 10 and a layer of silicone sealant 96 is applied to bond protruding lip side 26 to window pane 10.

In all cases, the silicone sealant is applied to bond the window pane 10 to the retaining side of 28 of window frame 12 as well as to protruding lip side 26 of window frame 12.

Although in accordance with the present invention it is possible to use a spacer rod and a layer of silicone sealant to bond the window pane to the window frame, on only one side of the window frame it is preferred especially in high-rise buildings which utilize large window panes, that the spacer rods be utilized continuously on all four sides of the window frame in accordance with the disclosure of FIGS. 1, 2, 3, 4, 5, and 6.

Spacer rods 18, 32 and 36, that is, taking any of the spacer rods in FIGS. 2, 3, 4, 5, and 6 and resting against retaining rod 28 such spacer rods are shown to be considerably larger in size than the spacer rod resting against protruding lip side 26. However, this does not have to be the case. The spacer rods can have any dimension, it is only required that they be of at least one-eighth of an inch in thickness to one-eighth of an inch in width, that is, it is only required that the silicone spacer rod, e.g. spacer rod 36 in FIG. 3, have a thickness of one-eighth of an inch and have a width along retaining side 28 of an eighth of an inch. In the same way, this is true of spacer rods 18 and 32 that is, it is only required that they have a thickness of one-eighth of an inch and a width along protruding lip side 26 of an eighth of an inch. Of course, spacer rods of larger dimensions can be utilized without any detrimental effect on the window construction, the only limitation on larger sizes being the construction of the window frame.

Generally speaking, the spacer rods such as spacer rod 38 resting against protruding lip side 26 will have a width and thickness of anywhere from one-half inch to 2 inches while the other spacer rods such as spacer rod 36 resting against retaining side 28 of window frame 12 generally will have a size of anywhere from one-half inch to up to the thickness of the glass pane. The length of such spacer rods as indicated in FIGS. 2, 3, 4, 5, and 6 preferably extends throughout the length of the particular side of the window on which such spacer rod is located.

In this respect, the amount of silicone sealant that is utilized can vary. It is generally preferred that the layer of silicone sealant, such layer 82, on the protruding lip side 26 of window frame 12 be at least a sixteenth of an inch thick and preferably should be one-eighth of an inch thick. In this respect, the layer of silicone sealant that is applied to bond retaining side 28 to window pane 10 for instance, layer 80, in FIGS. 2 and 6 on top of spacer rod 18 should be at least one-eighth of an inch thick while the width must be at least one-sixteenth of an inch. It should be noted that with respect to the thickness of the sealant, that is the thickness of silicone layer 82, 86, and 96 in FIGS. 3, 4, and 5, it is only necessary that the minimum thickness be maintained at the thinnest point between the window pane 10 and protruding lip side 26 of window frame 12 and that the layer of silicone sealant can be sloping for aesthetic effects as indicated for layers 82, 86 and 96 as shown in FIGS. 2, 3, 4 and 5.

After the layer of silicone sealant has been applied it is allowed to cure for as much as anywhere from 7 days to 21 days and the brackets 44, 46 and 42 may then simply be removed by unthreading screws 62, 66 and 72 leaving a clear window pane unobstructed by metal brackets and which window pane is flush with the window frame 12.

FIG. 6 simply adds to FIG. 2 in showing the layers of spacer rods in the window frame construction without the metal glass pane 10 present. For instance, there is disclosed in FIG. 6, spacer rod 20 and 38 resting on protruding lip side 26 and spacer rod 36 and 18 resting on retaining side 28 of window frame 12. The presence of Neoprene setting block 22 is also shown in the lower portion of FIG. 6. Lower bottom spacer rod 20 is indicated resting on protruding lip side 26 and retaining side 28. Also, in FIG. 6 there is shown the layer of silicone sealant 80 and 84. FIG. 6 just indicates the correct positioning of the Neoprene setting block 22 and the fact that Neoprene setting block 22 is of the same width and thickness as spacer rod 22 and also the fact that it does not extend along the entire bottom edge of window pane 10 but only extends for a short portion thereof as only short portions of such resting blocks are usually needed.

FIGS. 7 and 8 indicate that the silicone spacer rods 18 and 20 may come in two sections or may come in one section and this is also true of the other spacer rods around the other sides of window pane 10 and window frame 12. In fact, even spacer rod 18 may come in a number of sections. There is no requirement that the spacer rods along any side of window frame 12 be an integral unit or be comprised of a certain number of sections. If the spacer rod, such as spacer rods 18 and 20 are constructed from one integral section, as can be envisioned, there is economy in installation. However, such an integral construction can or cannot be utilized as may be desired.

FIG. 10 simply shows spacer rods 18 and 20 as an example which may apply to the other spacer rods along any side of window frame 12 in which spacer rod 18 is glued onto spacer rod 20 by a layer of silicone sealant 100 for reinforcement.

FIG. 9 shows the present concept being utilized to adjoin and adhere to adjacent window panes 110 and 112 where there is no protruding lip side 26 in the window frame construction. Window frame construction 114 simply has a retaining side 116 with silicone spacer rod 118 located thereon in which layers of silicone sealant 120, 122 and 126 are applied to bind window panes 110 and 112 together and to window frame retaining side 116. With respect to the comments made previously with respect to the size of the silicone sealant layers these comments still hold true. However, in this case as can be envisioned, while the thickness of the spacer rod dimensions given above still hold true, a larger width spacer rod is necessary in this application such as 4 to 10 inches. In the embodiment of FIG. 9, such spacer rod as well as silicone sealant will extend along the entire side of window pane 110 and 112.

As can also be envisioned, in the embodiment of FIG. 9, the method of retaining the window panes in place when the silicone sealant is applied and cured will vary from that shown in the previous figures. Such methods for retaining the window panes in place is well within the skill of the art and is well known to an ordinary worker skilled in the glazing art. As such it will not be described herein.

The silicone spacer rods should be constructed from heat vulcanizable silicone rubber compositions and it is conceivable that they could be constructed from room temperature vulcanizable silicone rubber compositions. Such heat vulcanizable compositions are generally formed by a mixture which has as the main ingredients an organopolysiloxane polymer or blend of polymers of a viscosity of anywhere from 1,000,000 to 200,000,000 centipoise at 25° C, where in the organo groups are selected from lower alkyl and aryl radicals as well as fluorinated hydrocarbon radicals and alkenyl radicals such as, vinyl in which polysiloxane polymer there is mixed various amounts of filler, the preferred filler being precipitated silica filler and fumed silica filler which fillers may be treated by various silicone process aids as is well known to the worker skilled in the art. There may also be extending fillers in addition to the above reinforcing fillers such as, diatomaceous earth, zinc oxide, ground quartz and various other types of well known extending fillers.

There may also be inserted into such composition other additives such as, flame retardant additives, for instance, platinum metal; heat aging additives, such as iron oxide and other additives known in the art. Such a composition is cured by mixing to it an alkyl peroxide and after forming the desired shape with the mixture, heating the mixture at a temperature of anywhere from 100° to 300° C for a period of 1 to 12 hours. If desired, the material may be post-baked to complete the cure. A preferred peroxide curing agent is, for instance, dicumyl peroxide.

An example of such a heat vulcanizable silicone rubber composition which can be utilized to form the spacer rods of the instant invention, one is referred to U.S. Pat. No. 3,814,722 of Glaister et al and U.S. Pat. No. 3,933,726 of Glaister, whose disclosures are hereby incorporated by reference.

The silicone sealants which may be utilized are well known room temperature vulcanizable silicone rubber compositions. For instance, one type of such composition in its broadest form comprises a silanol end-stopped diorganopolysiloxane polymer having a viscosity of anywhere from 1,000 to 500,000 centipoise at 25° C where the organo groups are selected from lower alkyl, fluorinated alkyl and phenyl and vinyl radicals into which there is mixed any of the well known fillers such as, the fillers for the heat vulcanizable silicone rubber compositions given previously. As in the case of the heat vulcanizable silicone rubber compositions such fillers may be treated with silicone compounds and non-silicone compounds such as, cyclopolysiloxanes and silazanes to enhance the properties of the fillers.

In addition, in its broadest form, such a room temperature vulcanizable silicone rubber composition sealant has in it a cross-linking agent which may be either an alkoxy functional silane or an acyloxy functional silane and there is preferably utilized as a catalyst the metal salt of a carboxylic acid or a titanium chelate in combination or separately.

In addition to the above, various types of dimethylpolysiloxane extenders and other heat-aging additives and flame retardants may be added to the basic room temperature vulcanizable silicone rubber composition sealants.

Such compositions are prepared in the anhydrous state, but when exposed to atmospheric moisture will cure at room temperature to form a silicone elastomer. Such compositions will completely cure in 24 hours upon exposure to atmospheric moisture.

Examples of room temperature vulcanizable silicone rubber compositions that can be utilized with the present invention are U.S. Pat. No. 3,296,161 of Kulpa and U.S. Pat. No. 3,689,454 of Hamilton et al, whose disclosures are hereby incorporated by reference.

The invention in the instant case lies in the utilization of a heat vulcanizable silicone rubber composition spacer rod in combination with a room temperature vulcanizable silicone rubber composition sealant for the reasons and advantages set forth herein above.

We claim:

1. A window pane construction in which the window pane is substantially flush with the exterior wall of a building and in which there is no external abutment lip on the external surface of said window pane comprising a four-sided window frame which has supporting sides extending around said opening and perpendicular to the opening in said window frame and lip sides which are perpendicular to said supporting sides and extending from the interior from said supporting sides to the edge of the building exterior, spacer rods formed from a heat vulcanizable silicone rubber of at least 30 Durometer Hardness extending along all four of said supporting sides of said window frame and extending along all four of said lip sides, but such that said spacer rods on said lip sides do not cover all of the surfaces of said lip sides which are perpendicular to the opening in said window frame so as to leave a toe surface on said lip sides, said toe surface extending on all sides of said window frame and external-most from the interior of the building, a window pane resting on and against and supported by said spacer rods, and a layer of a room temperature vulcanizable silicone rubber sealant applied over the exposed external surfaces of said spacer rods and extending from the toe surface on said lip sides to the edge of said window pane such that when said sealant has cured, the cured sealant maintains said window pane in place in conjunction with said spacer rods.

2. The window frame construction of claim 1 wherein said spacer rods are at least one-eighth of an inch thick and an eighth of an inch wide.

3. The window pane construction of claim 2 wherein said layer of silicone sealant is applied at least one-eighth of an inch thick and an eighth of an inch wide.

4. The window pane construction of claim 1 wherein said spacer rods have a Durometer Hardness in the range of 40 to 60.

5. The window pane construction of claim 4 wherein said spacer rods are present in more than one integral section along a particular side of said window frame and such that there is one section along said supporting sides and another separate section resting against said lip sides.

6. The window pane construction of claim 2 wherein said spacer rods extending along a particular side of the window frame and resting along said supporting sides and lip sides are constructed in one section.

7. The window pane construction of claim 5 wherein in the section of the spacer rod which is located below the window pane and on which the window pane rests there are sections cut out therefrom to form cavities and in which cavities there are located Neoprene setting blocks having a Durometer A Hardness in the range of 75 – 90 on which most of the weight of said window pane rests.

8. A process for installing a window pane substantially flush with the external walls of a building and in which there is no external abutment lip on the external surface of said window frame wherein there is present a four-sided window frame which has supporting sides extending around said opening and perpendicular to the opening in said window frame and lip sides which are perpendicular to said supporting sides and extending from the interior from said supporting sides to the edge of the building exterior comprising (a) placing along all four of said supporting sides and said lip sides spacer rods formed from a heat vulcanizable silicone rubber having a Durometer Hardness of at least 30, but such that said spacer rods on said lip sides do not cover all of the surface of said lip sides so as to leave a toe surface on said lip sides said toe surface extending on all sides of said window frame and external-most from the interior of the building; (b) resting on and against said spacer rods a window pane; and (c) applying a layer of room temperature vulcanizable silicone rubber sealant over the exposed external surface of said spacer rods and extending from the toe surface on said lip sides to the edge of said window pane such that when said sealant has cured, the cured sealant maintains said window frame in place in conjunction with said spacer rods.

9. The process of claim 8 wherein said spacer rod is at least one-eighth of an inch thick and one-eighth of an inch wide.

10. The process of claim 9 wherein said layer of silicone sealant is applied at least one-eighth of an inch thick and one-eighth of an inch wide.

11. The process of claim 8 wherein said spacer rod has a Durometer Hardness in the range of 40 to 60.

12. The process of claim 8 wherein said spacer rod is present in at least two sections along a particular side of said window pane such that there is one section resting behind said window pane and at least one other section located around the edge of said window pane.

13. The process of claim 12 wherein the spacer rods are formed into a single unit after installation by joining the edges by the use of a room temperature vulcanizable silicone rubber composition.

14. The process of claim 8 wherein said spacer rods on said supporting sides and said lip sides are constructed in one section.

15. The process of claim 8 wherein at that portion of the spacer rods which is below said window pane and on which the window pane rests there are sections cut out therefrom to form cavities and in which cavities there are located Neoprene setting blocks having a Durometer Hardness of at least 90 on which most of the weight of said window pane rests.

16. The process of claim 8 wherein after said window pane is rested on and against said spacer rods the pane is held in place by removable metal brackets which are affixed to said window frame after which said silicone sealant is applied and allowed to cure, further comprising removing said brackets to leave said window pane substantially flush with the exterior of said building said window pane being supported and retained by said spacer rods and said silicone sealant.

* * * * *